US011738957B2

(12) United States Patent
Steward et al.

(10) Patent No.: US 11,738,957 B2
(45) Date of Patent: Aug. 29, 2023

(54) FABRIC SEPARATOR

(71) Applicant: The North Face Apparel Corp., Wilmington, DE (US)

(72) Inventors: Dewayne Steward, Madison, NC (US); Demitri Balabanov, Greensboro, NC (US)

(73) Assignee: The North Face Apparel Corp., Wilmington, DE (US)

( * ) Notice: Subject to any disclaimer, the term of this patent is extended or adjusted under 35 U.S.C. 154(b) by 4 days.

(21) Appl. No.: 17/316,507

(22) Filed: May 10, 2021

(65) Prior Publication Data

US 2021/0309473 A1 Oct. 7, 2021

Related U.S. Application Data

(63) Continuation of application No. 16/912,692, filed on Jun. 25, 2020, now Pat. No. 11,161,705.

(60) Provisional application No. 62/869,524, filed on Jul. 1, 2019.

(51) Int. Cl.
*B65H 3/10* (2006.01)
*B65H 7/14* (2006.01)

(52) U.S. Cl.
CPC ..... *B65H 3/10* (2013.01); *B65H 7/14* (2013.01)

(58) Field of Classification Search
CPC ..... B65H 3/08; B65H 3/0808; B65H 3/0816; B65H 3/0883; B65H 3/10; B65H 3/128; B65H 3/14; B65H 7/14
See application file for complete search history.

(56) References Cited

U.S. PATENT DOCUMENTS 2,791,424 A 5/1957 Noon
2,819,075 A 1/1958 Noon
3,158,367 A * 11/1964 Tarbuck ..... B65H 3/14 271/30.1
3,168,307 A * 2/1965 Munchbach ..... D06F 67/04 38/143

(Continued)

FOREIGN PATENT DOCUMENTS

DE 4229955 A1 3/1994

OTHER PUBLICATIONS

International Search Report and Written Opinion dated Sep. 9, 2020 in PCT application No. PCT/US2020/039708, 7 pages.

(Continued)

*Primary Examiner* — Thomas A Morrison
(74) *Attorney, Agent, or Firm* — Smith, Gambrell & Russell LLP

(57) ABSTRACT

Some embodiments include a fabric separator comprising a body, a drum, a gas intake, a sensor, and a clamp. In some embodiments, the drum has an outer surface, is coupled with the body, and has a drum rotatable about an axis. The gas intake may flow gas in a rotational direction of the drum such that a low pressure zone is created on at least a portion of the outer surface of the drum. The sensor may be coupled with the body. The clamp may be in communication with the sensor and coupled with the body. The clamp having an engaged mode where the clamp is pressed against a portion of the drum and a disengaged where the clamp is not pressed against a portion of the drum, the clamp transitions from the engaged mode to the disengaged mode based on a signal from the sensor.

8 Claims, 5 Drawing Sheets

(56) References Cited

U.S. PATENT DOCUMENTS

| | | | | |
|---|---|---|---|---|
| 3,738,645 | A | 6/1973 | Gray et al. | |
| 4,594,597 | A * | 6/1986 | Liu | B41J 13/223 101/409 |
| 5,046,712 | A * | 9/1991 | Clapp | B65H 7/20 271/65 |
| 5,743,522 | A * | 4/1998 | Rubscha | B65H 1/04 271/145 |
| 6,393,978 | B1 * | 5/2002 | Sugawara | B41L 13/06 101/118 |
| 9,120,634 | B1 | 9/2015 | Muir et al. | |
| 9,555,985 | B2 * | 1/2017 | Kimura | H04N 1/0079 |
| 2004/0217540 | A1 * | 11/2004 | Sinai | B65H 3/14 271/98 |
| 2007/0120315 | A1 | 5/2007 | Steinhilber | |
| 2009/0302523 | A1 * | 12/2009 | Wattyn | B65H 5/08 271/12 |
| 2021/0002093 | A1 | 1/2021 | Steward | |

OTHER PUBLICATIONS

Non-Final Office Action dated Feb. 1, 2021 in U.S. Appl. No. 16/912,692, 8 pages.

Notice of Allowance dated Mar. 17, 2021 in U.S. Appl. No. 16/912,692, 14 pages.

International Search Report and Written Opinion received for Application No. PCT/US2020/040269 dated Oct. 22, 2020, 17 pages.

* cited by examiner

FABRIC SEPARATOR

BACKGROUND

Modern manufacturing methods often involve robotics and automation. In many manufacturing operations, a sheet of material must be separated from a stack of materials, so that operations can be performed on the sheet of material. In particular, the textile industry relies on a fabric picker to pick a top sheet of fabric from a stack of similar fabrics to which operations are performed. For example, a single sheet of cotton fabric may be picked so that the single sheet can be prepared for sewing to one or more other sheets of fabric in a process of making an article of clothing.

SUMMARY

Some embodiments of this disclosure include a fabric separator comprising a body, a drum, a gas intake, a flagging sensor, and a clamp. In some embodiments, the drum has an outer surface, is coupled with the body, and has a drum rotatable about an axis. The gas intake may flow gas in a rotational direction of the drum such that a low pressure zone is created on at least a portion of the outer surface of the drum. The flagging sensor may be coupled with the body. The clamp may be in communication with the flagging sensor and coupled with the body. The clamp having an engaged mode where the clamp is pressed against a portion of the drum and a disengaged where the clamp is not pressed against a portion of the drum, the clamp transitions from the engaged mode to the disengaged mode based on a signal from the flagging sensor.

In some embodiments, the low pressure zone is located between the drum and a fabric ply stack.

In some embodiments, the body comprises a wall with a concave surface that follows the circumference of a portion of the drum.

Some embodiments further comprise a robotic arm coupled with the body.

In some embodiments, the gas is pressurized gas and the drum is rotated by the gas flow.

In some embodiments, the gas intake has an outer opening disposed outside the body and an inner opening disposed near the drum wherein the diameter of the outer opening is larger than the diameter of the inner opening.

In some embodiments, the gas intake has a substantially frustoconical shape.

In some embodiments, the clamp comprises a linear actuator that when actuated moves the clamp into the engaged mode and when unactuated moves the clamp in the disengaged mode.

In some embodiments, the clamp comprises two members that extend away from the body in the disengaged mode and articulate toward the surface of the drum in the engaged mode.

In some embodiments, the flagging sensor comprises an infrared sensor.

Some embodiments include a method comprising: flowing gas through a gas intake; rotating a drum disposed with the body; detecting flagging of a ply of fabric near the rotating drum using a flagging sensor; and clamping the ply of fabric to an outer surface of the drum. The method may further include creating a low pressure zone between the drum and the ply of fabric.

In some embodiments, in response to detecting flagging of the ply of fabric, stopping the rotating drum. In some embodiments, in response to detecting flagging of the ply of fabric, stopping the stopping the flow gas through the intake.

In some embodiments, the clamping of the ply of fabric occurs in response to detecting flagging of the ply of fabric.

In some embodiments, the clamping of the ply of fabric is engaged in response to detecting flagging of the ply of fabric.

Some embodiments of this disclosure describes a fabric separator. The described fabric separator improves on conventional fabric separators by effectively and consistently, relative to conventional systems, separating a top fabric layer from a stack of fabric. The described fabric separator may be effective for fabrics of various types, rigidity, and sizes. Additionally, the fabric separator may separate fabrics more quickly and may be less expensive to manufacture and to operate, when compared to conventional systems.

In some embodiments, a fabric separator comprises an intake configured to receive a flow of gas with the intake coupled to one or more walls defining a portion of a cavity of the fabric separator. The fabric separator also includes a drum defining another portion of the cavity of the fabric separator. The cavity provides a space between a lower surface of the drum and a wall defining another portion of the cavity such that gas is able to flow from the intake, through the cavity, and out of the cavity via the space. The fabric separator is configured to interact with a fabric ply stack such that, when receiving a flow of gas, the flow of gas creates a low pressure zone along a surface of the drum that is opposite the cavity. In some implementations, the drum is configured to rotate such that the surface of the drum rotates along a path of the flow of gas within the cavity. The drum may amplify the effect of the flow of gas to create the low pressure zone along the surface of the drum that is opposite the cavity. The low pressure zone is effective to lift a top fabric layer from the fabric ply stack.

In some embodiments, the drum is configured to rotate along an axis generally parallel to an upper surface of the fabric ply stack.

In some embodiments, the drum is configured to rotate in response to the gas flowing from the intake into the cavity.

In some embodiments, the fabric separator further comprises a motor configured to power rotation of the drum.

In some embodiments, the intake has an upstream opening having an area that is greater than that of a downstream opening.

In some embodiments, the intake is generally frustoconical.

In some embodiments, the cavity is partially defined by a curved surface such that a distance between the curved surface and the drum is generally uniform.

In some embodiments, the fabric separator further comprises a clamp configured to clamp the top fabric layer in response to the top fabric layer is lifted from the fabric ply stack.

In some embodiments, the clamp comprises a finger clamp configured to curl around the surface of the drum.

In some embodiments, the fabric separator further comprises a flagging sensor configured to detect flagging of the top fabric layer proximate to the drum.

In an example method of operating a fabric separator, the fabric separator receives a flow of gas via an intake where the flow of gas received via the intake is delivered downstream into a cavity and wherein the cavity is partially defined by a drum and includes a space at a lower surface of the drum for the gas to escape the cavity. The method further includes detecting flagging of a top fabric layer and clamping the top fabric layer.

In some embodiments, the fabric separator powers rotation of the drum.

In some embodiments, the fabric separator detects flagging of a top fabric layer before, and triggering, the clamping of the top fabric layer.

In some embodiments, the fabric separator stops the flow of gas via the intake in response to clamping the top fabric layer.

The various embodiments described in the summary and this document are provided not to limit or define the disclosure or the scope of the claims.

DETAILED DESCRIPTION

Figure 1:
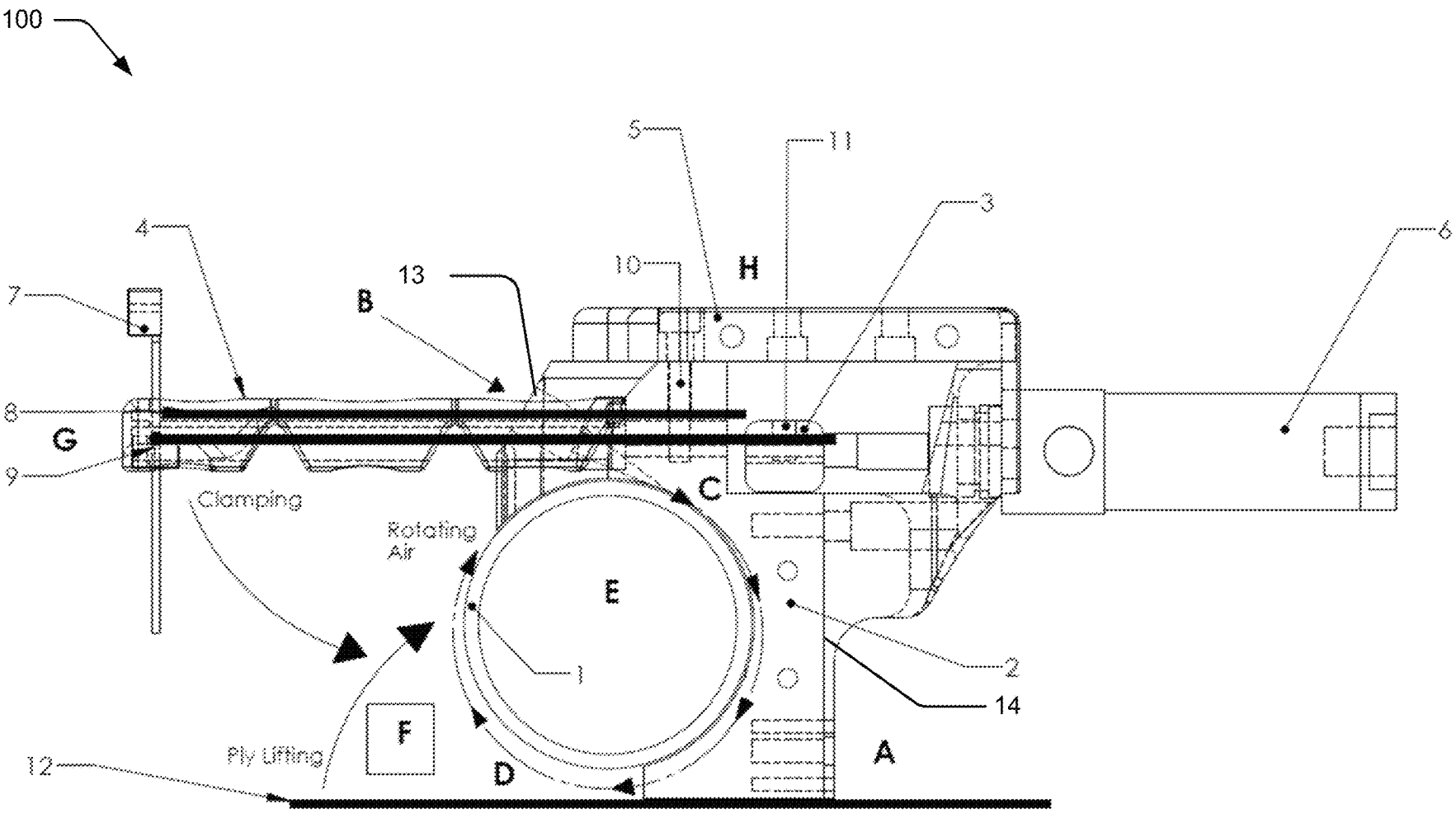
FIG. 1 is a side view of an example fabric separator according to some embodiments.
Figure 2:
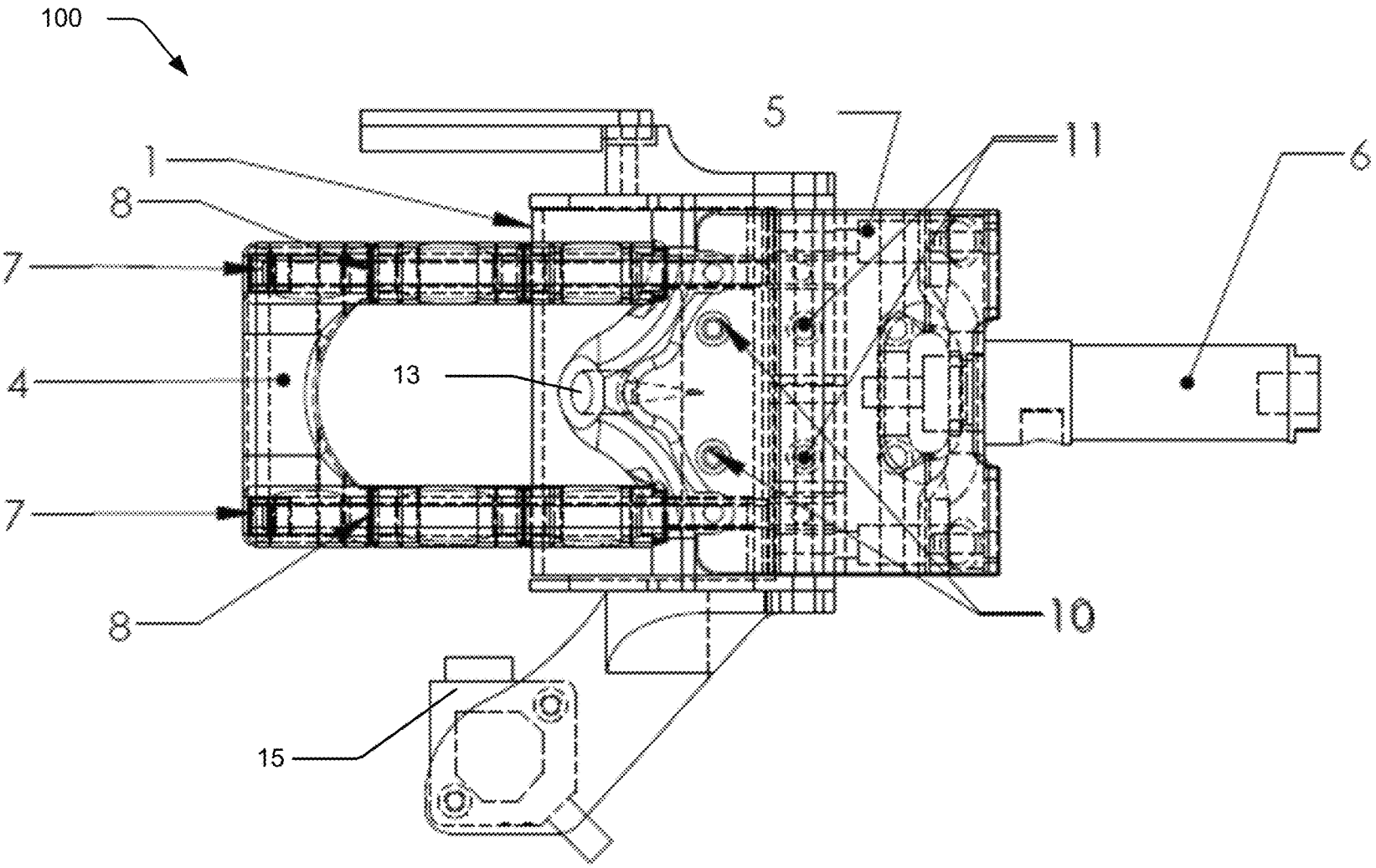
FIG. 2 is a top view of the example fabric separator of FIG. 1.
Figure 3:
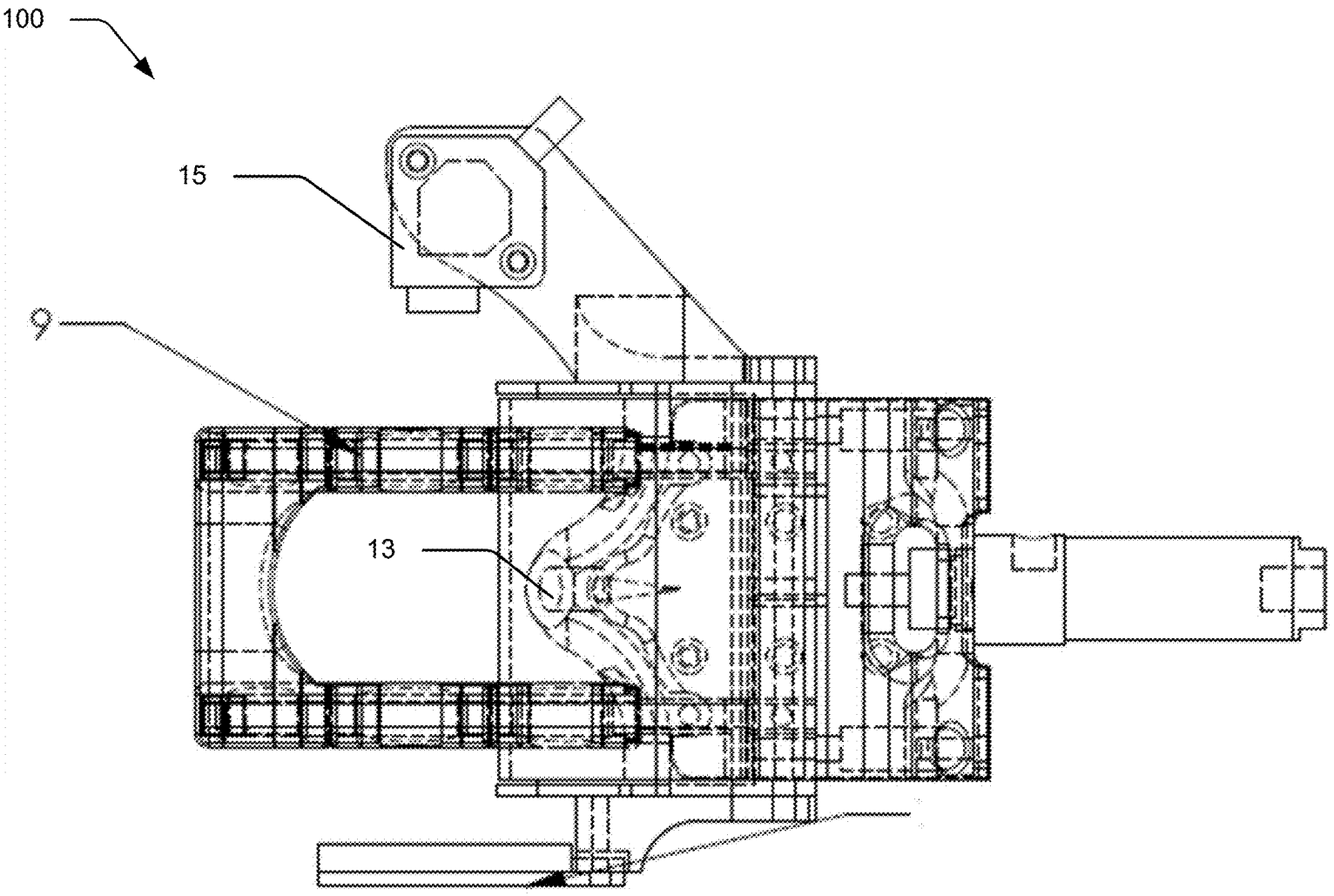
FIG. 3 is a bottom view of the example fabric separator of FIG. 1.
Figure 4:
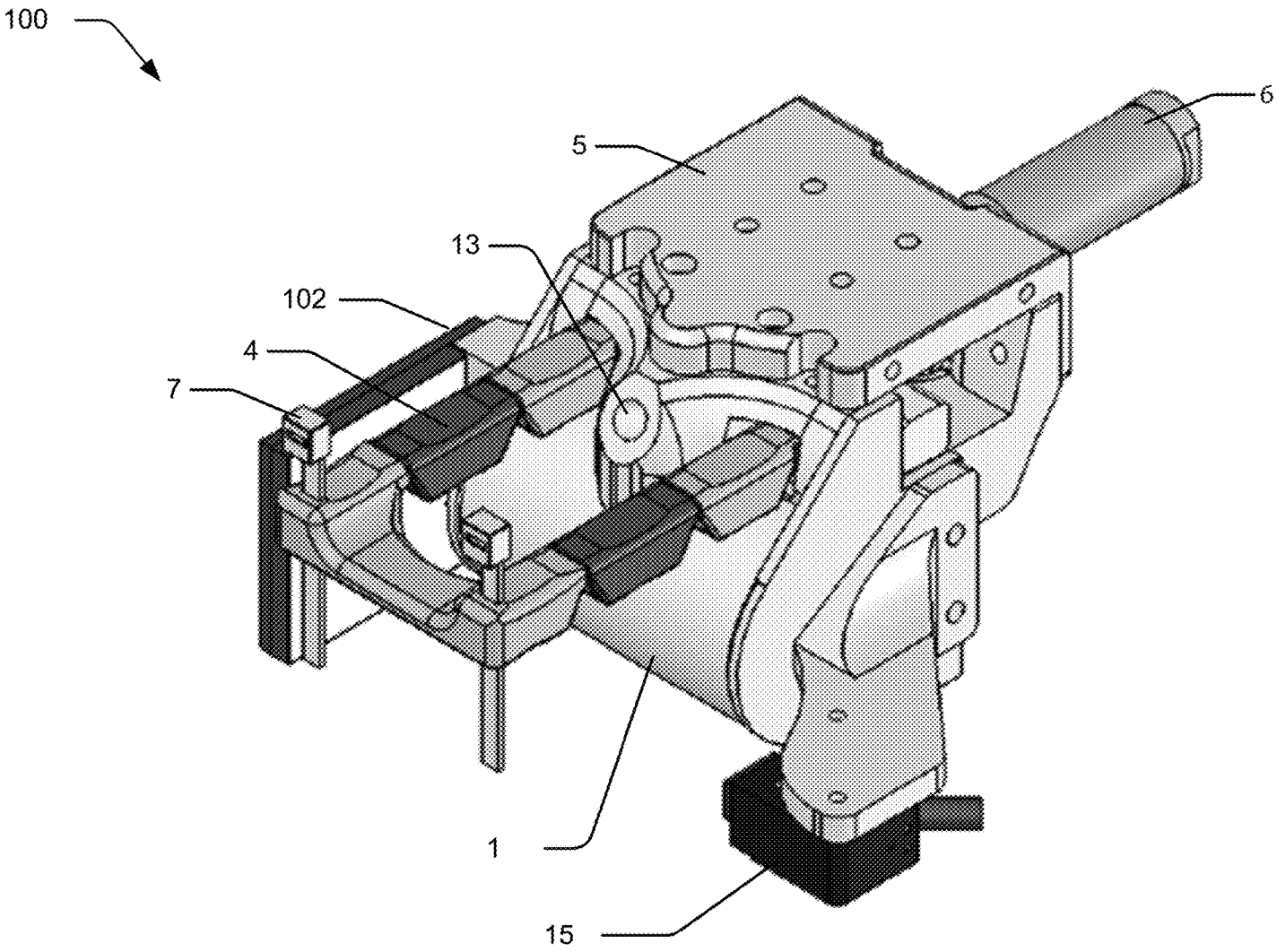
FIG. 4 is a perspective view of the example fabric separator of FIG. 1.

Some embodiments include a fabric separator that can separate a ply of fabric from a stack of fabric. The fabric separator may include an air intake and a drum. The air intake can rotate the drum. The combination of high pressure air and rotation of the drum can create a low pressure zone when place near a stack of fabric plies. This low pressure zone may cause the top ply of fabric to flag and begin to rotate around the drum. A clamp may then engage the fabric ply against the drum and allow the device to separate the fabric ply from the stack of fabric plies.

The described implementations of the fabric separator provide a fabric separator having improved effectiveness, versatility, manufacturing cost, and/or operating cost. The improved performance of the disclosed fabric separator, for example, can result in fewer malfunctions or fabric jams, which can reduce an amount of required supervision during operation.

FIGS. 1-4 illustrate an example implementation of a fabric separator 100. The fabric separator 100 may or may not include one or more of a drum 1, a cavity 2, a actuator clamp 3, a finger clamp 4, a universal mount 5, an actuator 6, a locking cable tie 7, a top tendon 8, a pulling bottom tendon 9, a top fastener 10, a clamp fastener 11, and/or an gas intake 13. The figures also show a fabric ply stack 12 (also referenced as a "fabric stack" or "ply stack").

In some embodiments, the fabric separator 100 receives a gas through the gas intake 13. The gas, for example, may be received in a steady stream, one or more pulses, or a stream that stops or reduces flow between iterations of separating top layers of the fabric ply stack. For example, the stream may begin in response to a proximity sensor detecting that the fabric separator 100 has contacted a fabric stack 12.

In some embodiments, the gas intake 13 has an upstream opening that has cross sectional an area that is greater than the cross sectional area of a downstream opening. The gas may enter the gas intake 13 via the upstream opening. The gas intake 13 may include a port for coupling to a gas source and/or a reducing chamber. The port, for example, may be threaded and/or assist in coupling the gas intake 13 with a gas source. The reducing chamber may be generally conical or frustoconical. In this way, for example, the gas may be pressurized as it proceeds downstream. The downstream opening may be tangent to, or generally orthogonal to, an outer surface of the drum 1.

In some embodiments, the gas intake 13 may be coupled with a solenoid that may regulate the flow of gas through the gas intake 13. In one mode, the gas my flow through the gas intake 13, and in another mode, the gas may not flow through the gas intake 13.

In some embodiments, the gas source may be a pressurized gas source such as an air compressor. In some embodiments, the gas may have a pressure of 15, 20, 25, 30, 35, 40, 45, 50, 55, 60, 65, 70, 75, 80 or more PSI. In some embodiments, the gas may comprise air or nitrogen.

The port may, for example, have a diameter between about ⅛ of an inch and about ¾ of an inch, inclusively. In some embodiments, the diameter may be about ⅓ of an inch. The port may be threaded to assist with coupling a gas source to the reducing chamber. In some embodiments, the gas source can be directly coupled to the reducing chamber without the port.

In some embodiments, the reducing chamber may have an upstream opening with a diameter between about ⅛ and about ½ inches, inclusively. The reducing chamber may have a downstream opening with a diameter between about 1/32 and about ⅛ inches, inclusively. In some embodiments, the diameter of the downstream opening may be less than the diameter of the upstream opening. In some embodiments, the reducing chamber may have a length that is proportional to a diameter of the upstream opening. In some embodiments, the length of the reducing chamber may be between about 3, 5, 8, 10 or more times the diameter of the upstream opening.

The drum 1 may have a diameter between about 0.5 and about 4 inches, inclusively. In some of these implementations, the drum 1 may have a diameter of about 2 inches. In some embodiments, the drum 1 may have a length between about 1 and about 12 inches, inclusively. In some embodiments, the drum may have a length of about 3 inches. In some embodiments, an additional gas intake 13 may be used for a relatively long drum 1. For example, a relatively long drum 1 having a length equal to or greater than about 4 inches may include one or more additional intakes 13.

Some embodiments may include multiple fabric separators 100 with each fabric separator 100 coupled with a common gas source. For example, each of the intakes 13 may be coupled to the common gas source in parallel such that each of the fabric separators 100 can tap into the common gas source when other fabric separators are not in operation.

In some embodiments, the drum 1 may rotate about an axis extending outward (e.g., perpendicularly from the page) from the side view of FIG. 1. The drum 1 may be rotated (e.g., clockwise in FIG. 1) by the flow of gas from the downstream opening of the gas intake 13. Additionally or alternatively, the drum 1 may be rotated by a motor and/or a belt drive system. If the drum 1 is rotated by a source other than the flow of gas alone, for example, a volume of gas needed to effectively operate the fabric separator 100 may be lowered when compared to a fabric separator 100 having the drum rotated by the flow of gas alone.

In some embodiments, the drum may rotate at a rate of more than 30, 60, 90, 150, 200, 250, 300 RPM.

In some embodiments, all or a portion of the exterior surface of the drum 1 may comprise a hard material such as plastic or metal and/or all or a portion of the exterior surface may comprise a soft material such as rubber or other synthetic material. In some embodiments, the exterior surface may be smooth, textured, or may have gripping ridges like those found on an automobile tire.

After the gas exits the downstream opening of the gas intake 13, the gas may enter a cavity 2 that is defined by one or more walls 14 and the drum 1. The one or more walls 14 may substantially seal the cavity 2. The gas may be forced to exit the cavity at an opening between the drum 1 and a lower surface (e.g., the surface proximate to the fabric ply stack 12). The one or more walls 14, for example, may include one or more walls shaped as an exterior surface of a polygonal prism. Additionally or alternatively, the one or more walls 14 may be curved to follow a curvature of the drum 1 such that the cavity has a substantially uniform thickness between the curved wall and the drum 1. In some embodiments, the one or more walls 14 may also include side walls that extend along outside surfaces (the circular surfaces) of the drum 1. These side walls may stop, or reduce and amount of, gas escaping from the cavity 2 through the ends of the drum. Additionally or alternatively, the side walls may keep the drum 1 in place, while allowing the drum 1 to rotate about an axel.

In some embodiments, as the gas enters the cavity 2, the gas may spread and flatten. In some embodiments, the gas may provide force on the drum to cause the drum to rotate. In some embodiments, the drum may rotate as the gas passes through the cavity 2. In some embodiments, the gas may be pressurized between about 10 pounds per square inch (PSI) and about 100 PSI, between about 25 PSI and about 80 PSI, between about 40 PSI and about 80 PSI, or between about 60 PSI and about 80 PSI. In some methods of operation, higher pressures can be used for heavier fabrics.

In some embodiments, as the gas flows between the lower surface of the drum 1 and the fabric ply stack 12, the flowing gas creates a low pressure zone that can cause the top fabric layer to lift from the fabric ply stack 12. In some embodiments, the rotation of the drum 1 may amplify the effect of the flow of gas to create the low pressure zone along the surface of the drum that is opposite the cavity. A free end of the top fabric layer may lift and curve toward a front surface (shown in FIG. 1 as the left surface) of the drum 1 (shown with an arrow labeled "Ply Lifting" in FIG. 1).

In implementations where the drum 1 is configured to rotate, its rotation may cause some of the gas to flow along the front surface of the drum 1. In some embodiments, some of the gas may flow to an upper surface of the drum 1 (e.g., opposite the lower surface). Some of the gas may also recirculate through the cavity 2. The flowing gas may continue the low pressure zone around, or proximate to, the front surface of the drum 1.

When the top layer of the fabric curves toward the front surface of the drum 1, the flowing gas may cause the top fabric layer to vibrate against the front surface of the drum 1, causing a flagging effect. The flagging effect may shake loose, from the top layer, any additional layers of fabric, which may have been lifted by friction, strings, static electricity, or mild fusing, etc.

In some embodiments, the fabric separator 100 may also include a flagging sensor 15. The flagging sensor 15 may be positioned to detect flagging. In some implementations, the flagging sensor 15 may be configured to detect adequate flagging to reliably separate the top layer from additional layers of fabric. For example, the flagging sensor 15 may detect flagging for a predetermined amount of time. The flagging sensor 15, for example, may also detect a predetermined count of flagging motions, or a predetermined count within a specified time interval.

In some embodiments, the flagging sensor 15 may include a pressure switch, a microswitch, an optical sensor, an IR sensor, a beam interrupt sensor, a lidar, etc. The flagging sensor 15 may, for example, detect a piece of fabric near the drum. The flagging sensor 15 may, for example, detect the number of times a piece of fabric moves near the drum in a set period of time. The flagging sensor 15 may, for example, detect the amount of time a piece of fabric is near the drum.

In some embodiments, the flagging sensor 15 may include light source and a reflective surface and/or a beam detector. The flagging sensor 15 may detect the top fabric layer passing through a path of light emitted by the light source and reflected by a surface on opposite ends of the drum 1.

Some embodiments may include an actuator 6. The actuator 6 may be activated in response to the top fabric layer lifting from the fabric ply stack 12. For example, the actuator 6 may be activated based on a signal from the flagging sensor 15 that indicates that adequate flagging has occurred and/or the fabric is in a position to be clamped.

The actuator 6 may, for example, comprise a pneumatic actuator or an electric linear actuator. The actuator 6 may activate the finger clamp 4 that may hold a piece of fabric against the drum 1.

In some embodiments, the actuator 6 may actuate (e.g., pull) the actuator clamp 3 that pulls the bottom tendon 9 of the finger clamp 4. This action may, for example, cause the finger clamp 4 to curl downward toward the drum 1 and hold a fabric layer against the drum 1. The finger clamp 4, for example, may include a lower surface that is soft or textured that may grip the top fabric layer when curled around the drum 1.

In some embodiments, a rod of the actuator 6 may thread into the actuator clamp 3 to adjust stroke and/or may be held with a locking nut. In some embodiments, the pressure on the actuator 6 may be adjustable.

In some embodiments, the finger clamp 4 may replicate a curling action of a human finger, with two or more member being connected as one unit, providing a clamping surface on the lower surface of each of the fingers. Each of the members of the finger clamp 4 may have two or more joints that allows each member to articulate toward the drum 1 when the actuator 6 is engaged.

In some embodiments, the top tendon 8 may be fixed to a relatively stationary component of the fabric separator 100. For example, the top fastener 10 may be threaded into the cavity 2 and/or may hold the top tendon 8 stationary relative to the fabric separator 100.

In some embodiments, the fastener 11 may also be used to hold the pulling bottom tendon 9 inside the actuator clamp 3. The actuator clamp 3 may, for example, be moved by the actuator 6 and/or may cause the finger clamp 4 to curl, while the top tendon 8 gives the structure rigidity.

In some embodiments, the bottom tendon 9 may be held inside tips of the finger clamp 4 by a fastener, adhesive, welding bond, and/or other coupling means.

In some examples, the locking cable tie 7 may be inserted through a tip of each finger of the finger clamp 4 and though an end of the pulling bottom tendon 9. The locking cable tie 7 may lock the actuator 6 to the tips of the finger clamp 4.

Various other clamping systems or mechanisms may be used. For example, a lever arm connected could pivot a plate against the drum 1. As another example, a linear actuator (e.g., linear actuator 6) could be configured to pull a plate into the drum 1 to hold the top fabric layer. As another example, two strips of spring steel, one pulled against the other, could be used to achieve the same goal of curling the finger clamp 4 toward the drum 1.

In some embodiments, the top tendon 8 and/or the bottom tendon 9 with or without the covering material of the fingers may be sufficient for clamping materials.

In some embodiments, once the fingers of the finger clamp 4 have clamped, air flow to the drum 1, via the gas intake 13, may be stopped. The fabric separator 100 can then be moved relative to the fabric ply stack 12 to pull and/or peel the fabric from the stack such as, for example, using a robotic arm. For example, the fabric separator 100 may be moved vertically and/or laterally (e.g., relative to the fabric ply stack 12). In some embodiments, the fabric separator 100 may be moved in a direction parallel to the fabric ply stack and opposite the finger clamp 4 (e.g., to the right in FIG. 1). When the fabric has been peeled, the fabric separator 100 can be moved into a drop position where it may release the grip of the finger clamp 4 and may allow the fabric to fall from the fabric separator 100.

In some embodiments, the fabric separator 100 can be mounted, by a universal mount 5 for example, to a robotic arm or linear motion application for the removal of the plies of fabric. Dependent on the logic applied to the robotic arm or linear motion application, it may be possible to lay the clamped ply flatly either face-up or face-down.

Although FIGS. 1-4 describe an example implementation of a fabric separator 100, other implementations of fabric separators are contemplated. For example, any one or more elements or features described above may be combined or omitted from an implementation of a fabric separator. Thus, the scope of this disclosure includes implementations having any number of the elements or features described above and is not limited to an implementation having each of the elements and features discussed above or shown in the figures.

Figure 5:
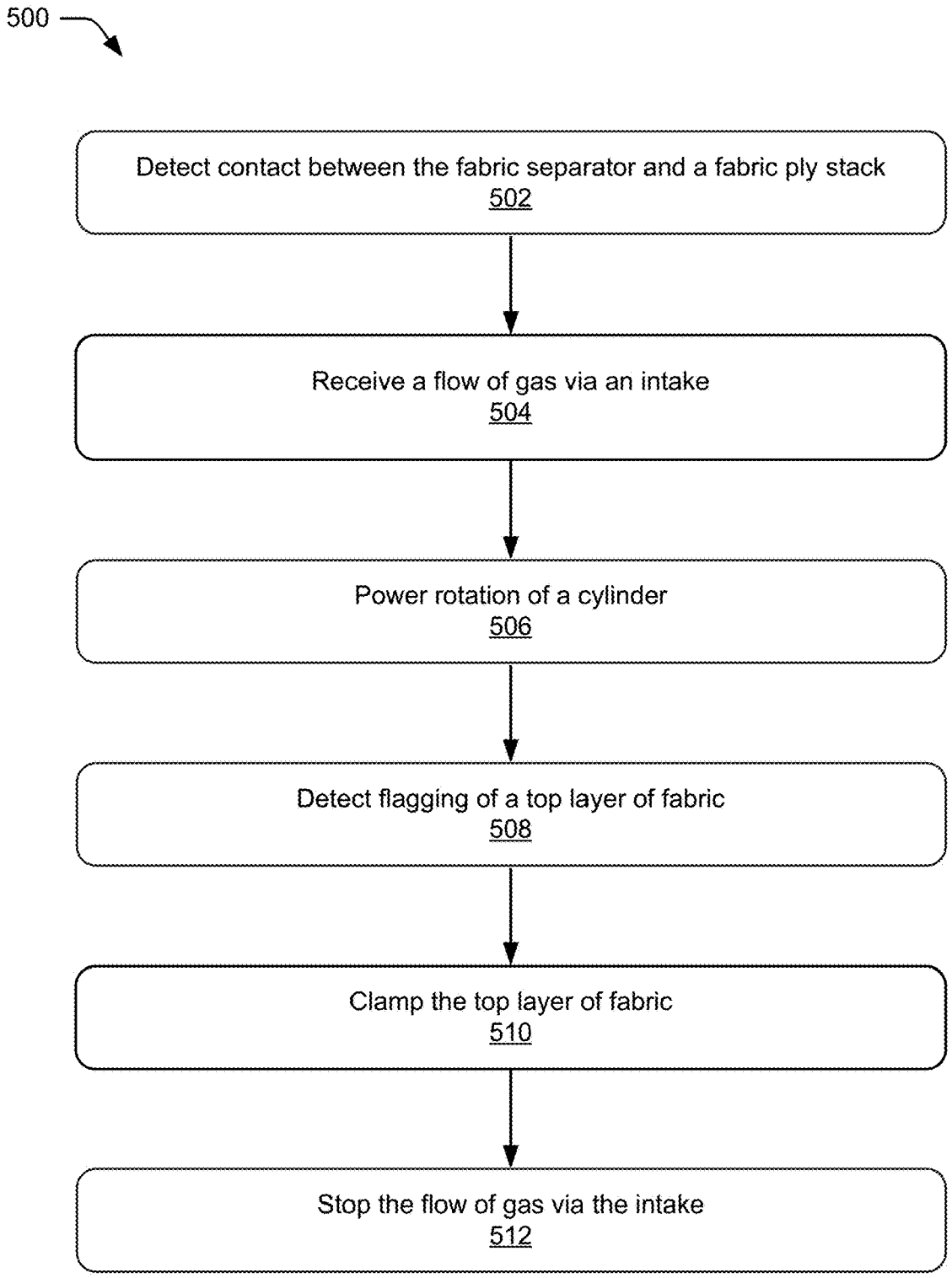
FIG. 5 is flow chart showing a method of operation of an example fabric separator according to some embodiments.

FIG. 5 illustrates a method 500 of operating a fabric separator. For illustrative purposes, but not by limitation, the steps of this method may be described relative to the implementation illustrated in FIGS. 1-4. Various blocks or steps of method 500 may be replaced or skipped or addition blocks may be added.

At block 502, a fabric separator 100 may detect contact between the fabric separator 100 and a fabric ply stack 12. This can occur using, for example, a proximity detector. In some embodiments, at block 502 the distance between the fabric separator 100 and the fabric ply stack 12 may be adjusted or set as needed to ensure proper air flow and/or low pressure zone is created.

At block 504, the fabric separator 100 may receive a flow of gas via the gas intake 13. The flow of gas, for example, may be received from a high pressure gas source such as, for example, an air compressor.

At block 506, the fabric separator 100 may or may not power the rotation of the drum of the fabric separator 100. In some embodiments, this may not be required.

At block 508, the fabric separator 100 may detect flagging of a top fabric layer of the fabric ply stack 12 such as, for example, by using a flagging sensor. A signal may be sent, for example, to the gas supply (e.g., a solenoid) and/or a controller.

At black 510, the fabric separator 100 may clamp a fabric ply against the drum such as, for example, using the finger clamp or any clamping device.

At block 512, the fabric separator 100 may stop the flow of gas via the intake, for example, either directly via a solenoid or by request to the source of the gas.

In some embodiments, the fabric separator may be in a disengaged mode. In the disengaged mode, the actuator may be disengaged (e.g., not pulled), the clamp may not be pressed against the drum, the gas may be flowing (e.g., a solenoid may be turned on), and/or the drum may be rotating.

In some embodiments, the fabric separator may be in a engaged mode. In the engaged mode, the actuator may be engaged (e.g., pulled), the clamp may be pressed against the drum, the gas may not be flowing (e.g., a solenoid may be turned off), and/or the rotation of the drum may be stopped.

Unless otherwise specified, the term "substantially" means within 5% or 10% of the value referred to or within manufacturing tolerances. Unless otherwise specified, the term "about" means within 5% or 10% of the value referred to or within manufacturing tolerances.

The conjunction "or" is inclusive.

The terms "first", "second", "third", etc. are used to distinguish respective elements and are not used to denote a particular order of those elements unless otherwise specified or order is explicitly described or required.

Numerous specific details are set forth to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general-purpose computing apparatus to a specialized computing apparatus implementing one or more embodiments of the present subject matter. Any suitable programming, scripting, or other type of language or combinations of languages may be used to implement the teachings contained in software to be used in programming or configuring a computing device.

Embodiments of the methods disclosed may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. A fabric separator comprising a body;

a drum with an outer surface coupled with the body, the drum rotatable about an axis, wherein a cavity is defined by one or more walls of the body and the drum, and wherein the one or more walls at least partially enclose the cavity;

a gas intake that receives gas external from the body and flows the gas into the cavity in a rotational direction of the drum sufficient to cause the drum to rotate, wherein the rotation of the drum amplifies an effect of the flow of gas to create a low pressure zone along a surface of the drum that is opposite the cavity as the drum rotates in response to the gas flow;

a flagging sensor coupled with the body; and a clamp in communication with the flagging sensor and coupled with the body, the clamp having an engaged mode and a disengaged mode, in the engaged mode the clamp is pressed against a portion of the drum and in the disengaged mode the clamp is not pressed against a portion of the drum, the clamp transitions from the engaged mode to the disengaged mode based on a signal from the flagging sensor.

2. The fabric separator according to claim 1, wherein the low pressure zone is located between the drum and a fabric ply stack.

3. The fabric separator according to claim 1, wherein the gas is pressurized gas and the drum is rotated by the gas flow.

4. The fabric separator according to claim 1, wherein the gas intake has an outer opening disposed outside the body and an inner opening disposed near the drum wherein a diameter of the outer opening is larger than a diameter of the inner opening.

5. The fabric separator according to claim 1, wherein the gas intake has a substantially frustoconical shape.

6. The fabric separator according to claim 1, wherein the clamp comprises a linear actuator that when actuated moves the clamp into the engaged mode and when unactuated moves the clamp in the disengaged mode.

7. The fabric separator according to claim 1, wherein the clamp comprises two members that extend away from the body in the disengaged mode and articulate toward the surface of the drum in the engaged mode.

8. The fabric separator according to claim 1, wherein the flagging sensor comprises an infrared sensor.

* * * * *